US010259601B2

(12) United States Patent
Van Den Elzen et al.

(10) Patent No.: US 10,259,601 B2
(45) **Date of Patent: *Apr. 16, 2019**

(54) METHOD AND DEVICE FOR PACKAGING PRODUCTS AND ARRAY OF PACKAGED PRODUCTS

(71) Applicant: Mars, Incorporated, McLean, VA (US)

(72) Inventors: Marinus J. H. M. Van Den Elzen, Van den Elzen (NL); Albertus C. H. Van Liempd, Veghel (NL)

(73) Assignee: Mars, Incorporated, McLean, VA (US)

( * ) Notice: Subject to any disclaimer, the term of this patent is extended or adjusted under 35 U.S.C. 154(b) by 1017 days.

This patent is subject to a terminal disclaimer.

(21) Appl. No.: 14/060,103

(22) Filed: Oct. 22, 2013

(65) Prior Publication Data

US 2014/0041342 A1 Feb. 13, 2014

Related U.S. Application Data

(63) Continuation of application No. 10/568,600, filed as application No. PCT/EP2004/051843 on Aug. 19, 2004, now Pat. No. 8,590,279.

(30) Foreign Application Priority Data

Aug. 20, 2003 (EP) ..... 03103206

(51) Int. Cl.
*B65B 5/02* (2006.01)
*B65B 35/10* (2006.01)
(Continued)

(52) U.S. Cl.
CPC ..... *B65B 5/02* (2013.01); *B65B 9/045* (2013.01); *B65B 25/005* (2013.01); *B65B 35/10* (2013.01); *B65B 51/225* (2013.01)

(58) Field of Classification Search
CPC ..... B65B 5/02; B65B 9/045; B65B 25/005; B65B 35/10; B65B 51/225
(Continued)

(56) References Cited

U.S. PATENT DOCUMENTS 1,640,052 A 8/1927 Olsen
2,213,758 A 9/1940 Eichberg
(Continued)

FOREIGN PATENT DOCUMENTS

BE 386380 3/1932
CH 421801 9/1966
(Continued)

OTHER PUBLICATIONS

Decision on Opposition issued in European Patent 2134624, dated Feb. 18, 2013.

(Continued)

*Primary Examiner* — Andrew M Tecco
*Assistant Examiner* — Praachi M Pathak

(57) ABSTRACT

A method for packaging products, such as candies, the method comprising the steps of positioning the products on a first sheet which is continuously moved in a transport direction, covering the products by a second sheet which is continuously moved in the same transport direction and which is aligned substantially plane-parallel to the first sheet, and sealing together the first and second sheets near the outer edges of the individual products or grouped products by a sealing device, wherein the sealing device comprises sealing ribs extending substantially transversely to the transport direction on one side of the moving sheets, wherein said sealing ribs are being moved at the same speed as the sheets and the sealing ribs seal the first and second sheets together in between the moving products.

14 Claims, 4 Drawing Sheets

(51) Int. Cl.
*B65B 9/04* (2006.01)
*B65B 25/00* (2006.01)
*B65B 51/22* (2006.01)

(58) Field of Classification Search
USPC ..... 53/453
See application file for complete search history.

(56) References Cited

U.S. PATENT DOCUMENTS 2,263,191 A 11/1941 Saladin et al.
2,320,143 A 5/1943 Johnson
2,408,616 A 10/1946 Eldridge
2,596,620 A 5/1952 Townsend
2,736,656 A 2/1956 Marshall
2,749,245 A 6/1956 Peters
2,956,710 A 10/1960 O'Connor
3,130,058 A 4/1964 Johnson
3,278,019 A 10/1966 Martin et al.
3,353,329 A 11/1967 Cloud et al.
3,354,613 A 11/1967 Anderson et al.
3,405,861 A 10/1968 Bush
3,481,100 A * 12/1969 Bergstrom ..... B65B 31/02 426/392
3,597,899 A 8/1971 Hanson
3,673,759 A 7/1972 Ayres et al.
3,684,614 A 8/1972 Lemelson
3,924,803 A 12/1975 De Habsburg
3,983,999 A 10/1976 Morton
4,034,536 A * 7/1977 Mahaffy ..... B29C 51/22 53/427
4,053,046 A 10/1977 Roark
4,133,163 A * 1/1979 Wilson ..... B65B 9/02 53/141
4,154,636 A * 5/1979 Motoyama ..... A61J 3/005 156/243
4,290,526 A 9/1981 Haiss
4,506,495 A 3/1985 Romagnoli
4,604,852 A * 8/1986 Becker ..... B65B 9/02 53/148
4,666,079 A 5/1987 Bolli et al.
4,723,701 A 2/1988 Deutschlander
4,724,997 A 2/1988 Hogenkamp
4,785,609 A 11/1988 Widmann
4,850,526 A 7/1989 Naef
4,897,983 A 2/1990 Hogenkamp
4,907,394 A 3/1990 Tschepke et al.
5,001,880 A 3/1991 Smith
5,018,625 A 5/1991 Focke et al.
5,029,712 A 7/1991 O'Brien
5,044,145 A * 9/1991 Brembilla ..... B29C 65/10 493/134
5,096,113 A 3/1992 Focke
5,100,003 A 3/1992 Jud
5,105,942 A 4/1992 Van Veen et al.
5,268,179 A * 12/1993 Rudella ..... A61K 9/7084 156/73.1
5,316,209 A 5/1994 Tomisawa et al.
5,459,980 A * 10/1995 Kenney ..... B65B 29/02 53/373.4
5,518,119 A 5/1996 Takahashi
5,752,365 A * 5/1998 Johnson ..... B65B 61/08 53/389.2
5,765,682 A 6/1998 Bley et al.
5,875,894 A 3/1999 Stromme
6,006,907 A 12/1999 Sato et al.
6,335,042 B1 1/2002 Money
6,574,944 B2 6/2003 Capodieci
6,776,285 B2 8/2004 Shibata
6,929,400 B2 8/2005 Razeti et al.
7,007,443 B2 * 3/2006 Liedtke ..... B65B 15/04 53/399
7,032,754 B2 4/2006 Kopecky
7,055,692 B2 6/2006 Waga et al.
7,350,688 B2 4/2008 Sierra-Gomez et al.
7,516,596 B2 * 4/2009 Henderson ..... B26F 1/14 206/494
7,533,773 B2 5/2009 Aldridge et al.
7,748,533 B2 7/2010 Van Marle et al.
7,886,898 B2 2/2011 Tsakiris
8,059,279 B2 11/2011 Iino et al.
8,308,363 B2 11/2012 Vogt et al.
8,505,716 B2 * 8/2013 Van Liempd ..... B65B 9/045 206/216
8,529,971 B2 9/2013 Modha
8,590,279 B2 * 11/2013 Van Den Elzen ..... B65B 9/045 53/453
8,658,229 B2 2/2014 Aldridge
2002/0157355 A1 * 10/2002 Tampieri ..... B29B 13/023 53/453
2004/0226849 A1 * 11/2004 Brenkus ..... B65B 9/20 206/484
2006/0218880 A1 * 10/2006 Sperry ..... B29C 65/229 53/403
2009/0273179 A1 11/2009 Scott et al.
2011/0244315 A1 * 10/2011 Yoon ..... H01M 2/0207 429/176
2018/0305058 A1 * 10/2018 Maruyama ..... A61J 1/03

FOREIGN PATENT DOCUMENTS

| | | |
|---|---|---|
| CN | 2316254 | 4/1999 |
| DE | 461794 | 6/1928 |
| DE | 19830258 | 1/2000 |
| EP | 1367005 | 12/2003 |
| EP | 1547936 | 6/2005 |
| GB | 124197 | 10/1919 |
| GB | 259165 | 10/1926 |
| GB | 670313 | 4/1952 |
| GB | 773128 | 4/1957 |
| GB | 850457 | 10/1960 |
| GB | 1297000 | 11/1972 |
| GB | 2336825 | 11/1999 |
| JP | 63-272612 | 11/1988 |
| JP | 9-202356 | 5/1997 |
| JP | 10147635 | 6/1998 |
| JP | 10152179 | 6/1998 |
| JP | 11301744 | 11/1999 |

OTHER PUBLICATIONS

Notice of Opposition in Connection with EP Patent No. 2134624, dated Jun. 22, 2011.
Oxford English Dictionary, Second Edition Revised, Oxford University Press, p. 464, 1995.
Patentee's Response to Notice of Opposition, in Connection with EP Patent No. 2134624, dated Nov. 29, 2011.

* cited by examiner

METHOD AND DEVICE FOR PACKAGING PRODUCTS AND ARRAY OF PACKAGED PRODUCTS

RELATED APPLICATIONS

This application is a continuation of co-pending U.S. application Ser. No. 10/568,600, having a filing date of Jan. 3, 2007, which is the National Stage Entry of PCT/EP04/51843, having a filing date of Aug. 19, 2004, which claims priority to European Application No. 03103206.3, having a filing date of Aug. 20, 2003.

SUMMARY OF THE INVENTION

The invention relates to a method for packaging products, such as candies, in a removable enclosure, wherein the products are positioned on a first sheet which is continuously moved in a transport direction, wherein the products are covered by a second sheet which is continuously moved in the same transport direction and which is aligned substantially plane-parallel to the first sheet, and wherein the first and second sheets are sealed together near the outer edges of the individual products or grouped products by a sealing device.

Such a method is used for providing a bandoleer of individually packaged products or of products that are grouped together in one sealed envelope, wherein the envelopes can be separated from each other at a later stage. The invention aims at an improved method, wherein products can be wrapped efficiently at a fast speed, wherein the packaging device can be easily adapted for differently sized products, wherein as little packaging material as possible is used, and/or wherein brittle products can be wrapped with as little damage possible.

To that end the sealing device comprises sealing ribs extending substantially transversely to the transport direction on one side of the moving sheets, wherein said sealing ribs are being moved at the same speed as the sheets and the sealing ribs seal the first and second sheets together in between the moving products. Thereby the sheets can move continuously, without the need to interrupt the movement for sealing the sheets together. Preferably the sealing device comprises a rotating frame, the rotation axis of said frame extending transversely to the transport direction, wherein said sealing ribs extend from a coaxial cylindrical surface of said frame.

In order to prevent damage to the products, in particular if the products have a substantial height, at least one of said sheets is preferably pre-shaped to fit at least partially around the products before the film comes into contact with the products. Said pre-shaping action is preferably performed by a pre-shaping device comprising a first rotating shaping frame on one side of the moving sheet and a second rotating shaping shape on the opposite side of the moving sheet, the rotation axes of both frames extending transversely to the transport direction of the sheet, wherein said frames comprise co-operating protruding shaping ribs extending substantially transversely to the transport direction, wherein the shaping ribs of both frames move between each other, and wherein said shaping ribs are being moved at the same speed as the pre-shaped sheet. Preferably the first pre-shaping frame is positioned such that it guides the pre-shaped film towards the other moving sheet while including the products. Preferably the first pre-shaping frame is the same frame as the rotating frame of the sealing device, and the shaping ribs on said frame are said sealing ribs.

The described method is particularly advantageous when the products have an elongated form and are positioned transversely on the first moving sheet. Preferably the sealing ribs comprise ultrasonic welding means. Preferably the sealed areas between the products are perforated or scored, such that the packaged products stay attached to each other, but can be easily separated.

The invention also relates to a device for packaging products, such as candies, comprising first transport means for continuously moving a first sheet in a transport direction, positioning means for positioning the products on the first sheet, second transport means for continuously moving a second sheet in the same transport direction in alignment substantially plane-parallel to the first sheet while covering the products, and a sealing device for sealing the first and second sheets together near the outer edges of the individual products, wherein the sealing device comprises protruding sealing ribs extending substantially transversely to the transport direction, and said sealing device further comprises synchronizing means for moving said sealing ribs at the same speed as the sheets while sealing the first and second sheets together in between the moving products.

Furthermore the invention relates to a method for packaging products, such as candies, wherein the products are positioned on a first sheet which is continuously moved in a transport direction, wherein the products are covered by a second sheet which is continuously moved in the same transport direction and which is aligned substantially plane-parallel to the first sheet, and wherein the first and second sheets are sealed together near the outer edges of the individual products by a sealing device, wherein at least one of said sheets is pre-shaped by a pre-shaping device to fit at least partially around the products before the sheet comes into contact with the products, wherein said pre-shaping device comprises a first rotating shaping frame on one side of the moving sheet and a second rotating shaping frame on the opposite side of the moving sheet, the rotation axes of both drums extending transversely to the transport direction of the sheet, wherein said frames comprise co-operating protruding shaping ribs extending substantially transversely to the transport direction, wherein the shaping ribs of both frames move between each other, and wherein said shaping ribs are being moved at the same speed as the pre-shaped sheet.

The invention also relates to a device for packaging products, such as candies, comprising first transport means for continuously moving a first sheet in a transport direction, positioning means for positioning the products on the first sheet, second transport means for continuously moving a second sheet in the same transport direction in alignment substantially plane-parallel to the first sheet while covering the products, a sealing device for sealing the first and second sheets together near the outer edges of the individual products, and a pre-shaping device for pre-shaping at least one of said sheets to fit at least partially around the products before the sheet comes into contact with the products, wherein said pre-shaping device comprises co-operating protruding shaping ribs extending substantially transversely to the transport direction, wherein the shaping ribs of both drums are movable between each other, and said pre-shaping device further comprises synchronizing means for moving said shaping ribs at the same speed as the pre-shaped sheet.

Further the invention relates to an array of packaged products, such as candies, comprising two sheets which are sealed together and enclose said products or groups of products, wherein the sealed areas between the products are weakened, for instance by scores of perforations, such that the packaged products can be easily separated, wherein one of said sheets is a substantially flat relatively rigid board or film and the other sheet is a relatively flexible foil shaped to fit at least partially around the products. Preferably the sides of the sealed sheets extending from the outer ends of the products are bend, upwards or downwards, in order to give the array rigidity in its longitudinal direction. In this manner a very efficiently packaged product is obtained. The extending sides of the sealed sheets can be given such a length that they can be bend further, over the packaged products and be sealed together, such that the rigid board forms a protective tubular box.

BRIEF DESCRIPTION OF THE DRAWINGS

The invention will be illustrated with reference to the drawings, wherein.

DETAILED DESCRIPTION OF THE INVENTION

Figure 1:
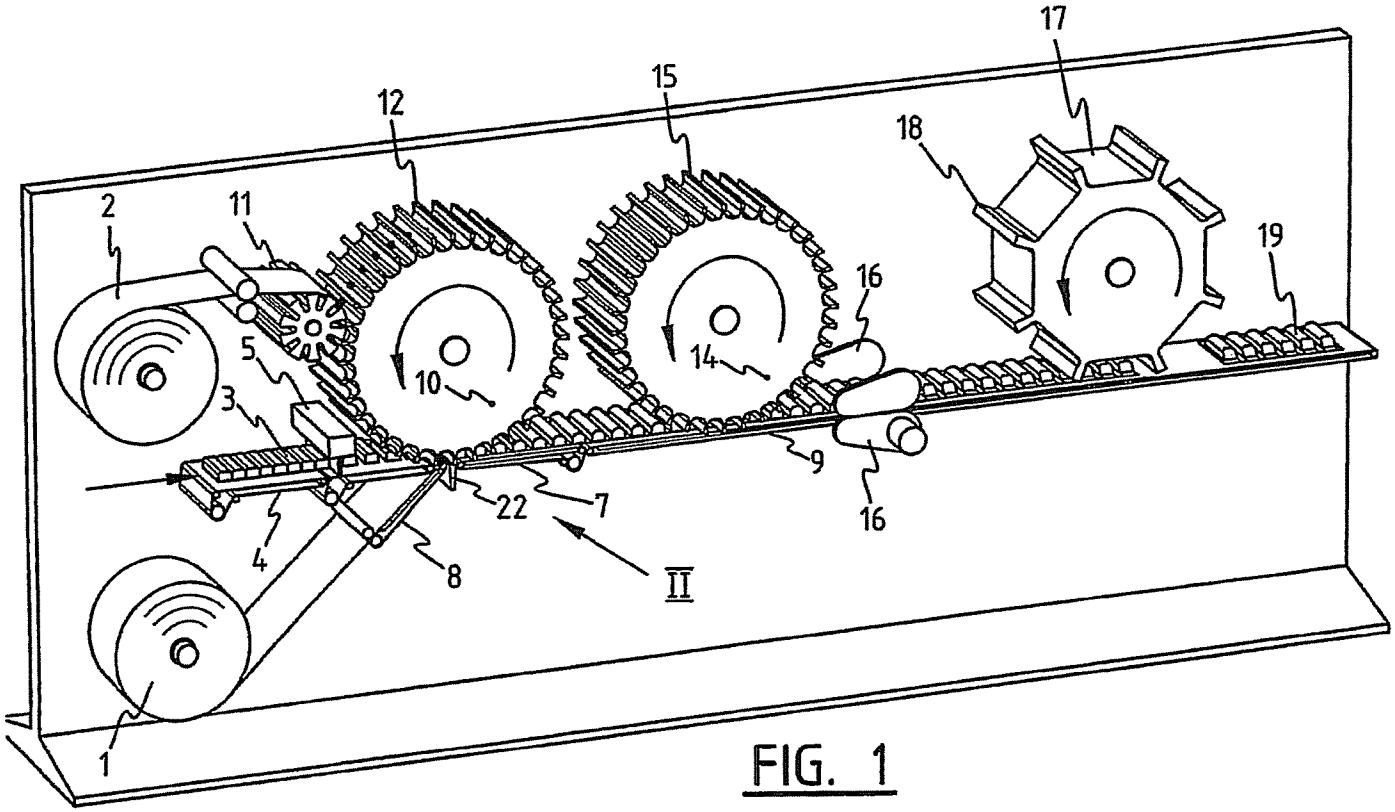
FIG. 1 shows a schematic perspective view of a packaging device.
Figure 2:
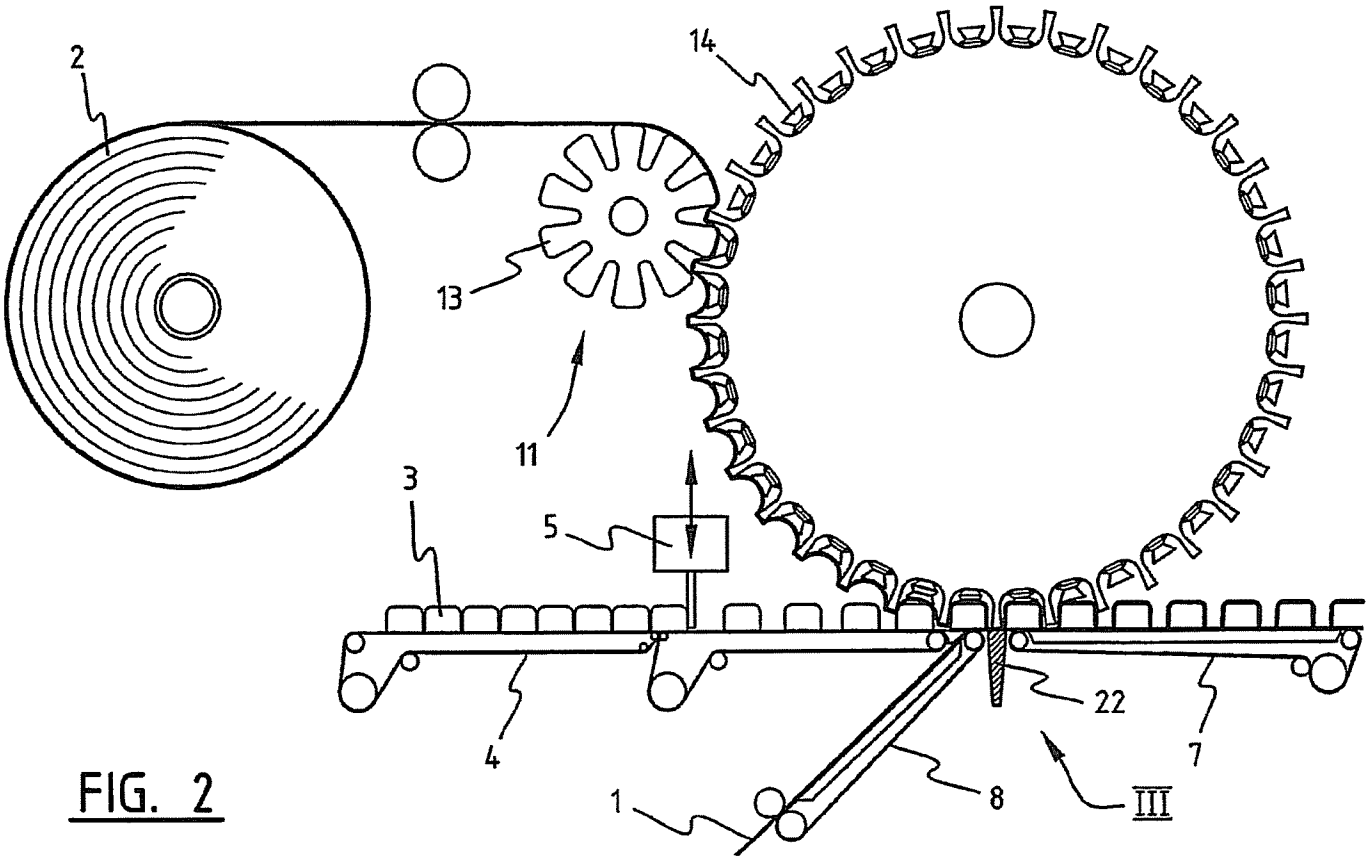
FIG. 2 shows a schematic side view of a detail of the packaging device of FIG. 1.
Figure 3:
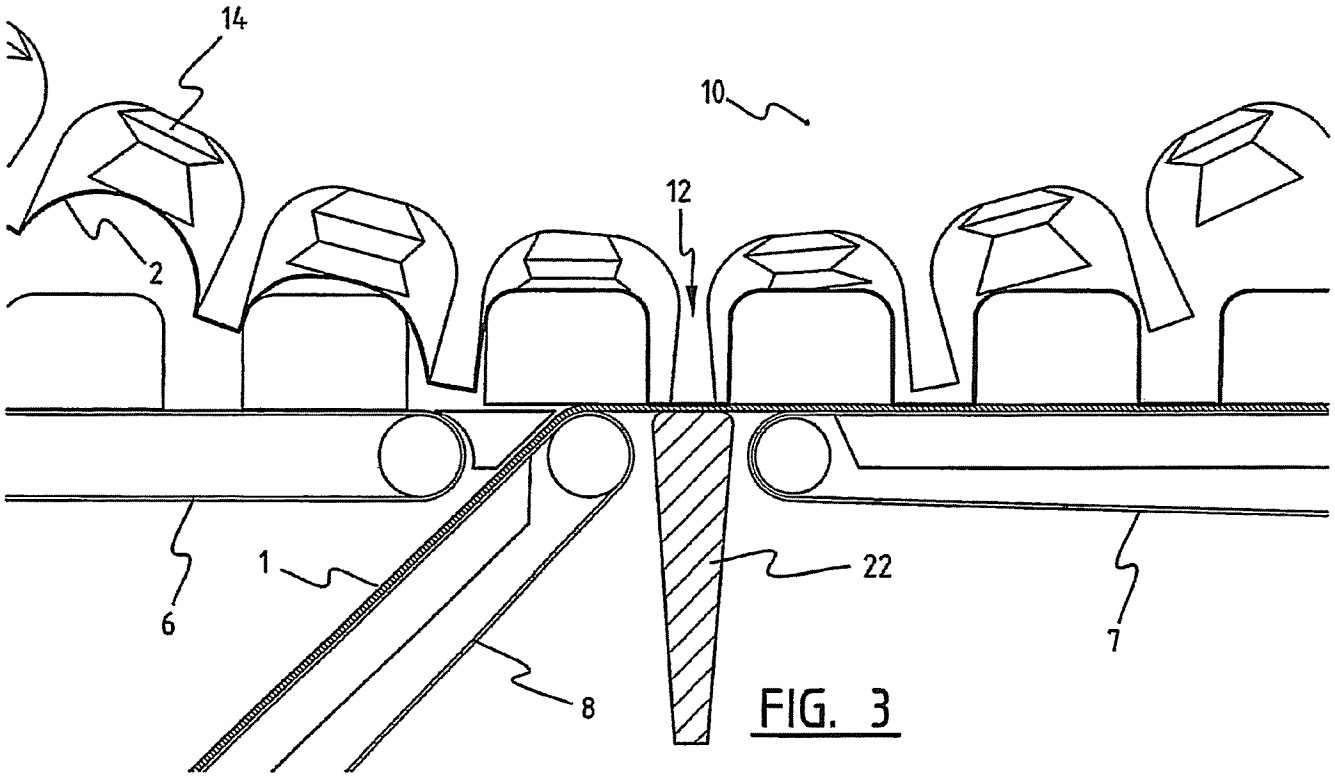
FIG. 3 shows a further schematic side view of a detail of the packaging device of FIG. 1.

With reference to FIGS. 1, 2 and 3 the packaging device has a first roll of card board 1 having a plastic coating on at least one side and a second roll of plastic film 2. The elongated candy bars 3 are placed transversely on a first endless conveyor 4. A separation device 5 has a barrier which moves up and down at regular intervals for spacing the candy bars 3 a pre-defined distance apart.

The second conveyor 6, the third conveyor 7, the fourth conveyor 8, the fifth conveyor 9, as well as the card board 1 all move at the same speed, which is larger than the speed of conveyor 4 in order to accommodate the larger mutual distance of the candy bars.

The plastic film 2 is led between a co-operating rotating shaping drums 10, 11. Both drums 10, 11 have protruding shaping ribs 12, 13 which during rotation are moved between each other like a gear unit, thereby corrugating the plastic film 2 into the desired shape. The drum 10 has flexible suction cups 14 between its ribs 12 which hold the pre-shaped film by a vacuum action force.

The pre-shaped film 2 is placed on top of the moving candy bars 3 by the drum 10 while they are at the same time being transferred by the conveyor 6 onto the coated side of moving cardboard 1. In this manner the candy bars 3 are enclosed in the cardboard 1 and the pre-shaped plastic film 2. When the ribs 12 are at their lowest point 2 they push the plastic film 2 onto the cardboard 1, where the plastic film 2 is welded on the coated side of cardboard 1 by a first ultrasonic welding device 22, which co-operate with ultrasonic welding means present in the sealing ribs 12. In this manner a series of interconnected tubes is formed, each tube comprising a candy bar. By changing the opening time of the separation device 5 also two or more candy bars 3 can be grouped together and enclosed in a single tube thereby.

Subsequently the transverse seals between the candy bars 3 are perforated or scored by a rotating drum 24 having scoring or perforating ribs 15. Then the ends of the film 1 which extend from the sides of the candy bars 3 are pushed down by two further ultrasonic sealing devices 16 and sealed to the cardboard 1, whereby the candy bars 3 are enclosed inside the cardboard and plastic film in an airtight manner. At this stage the candy bars 3 form an endless array of interconnected packaged products. The separation drum 17 separates the products into arrays 19 of for instance six candy bars each by means of cutting ribs 18.

Figure 4:
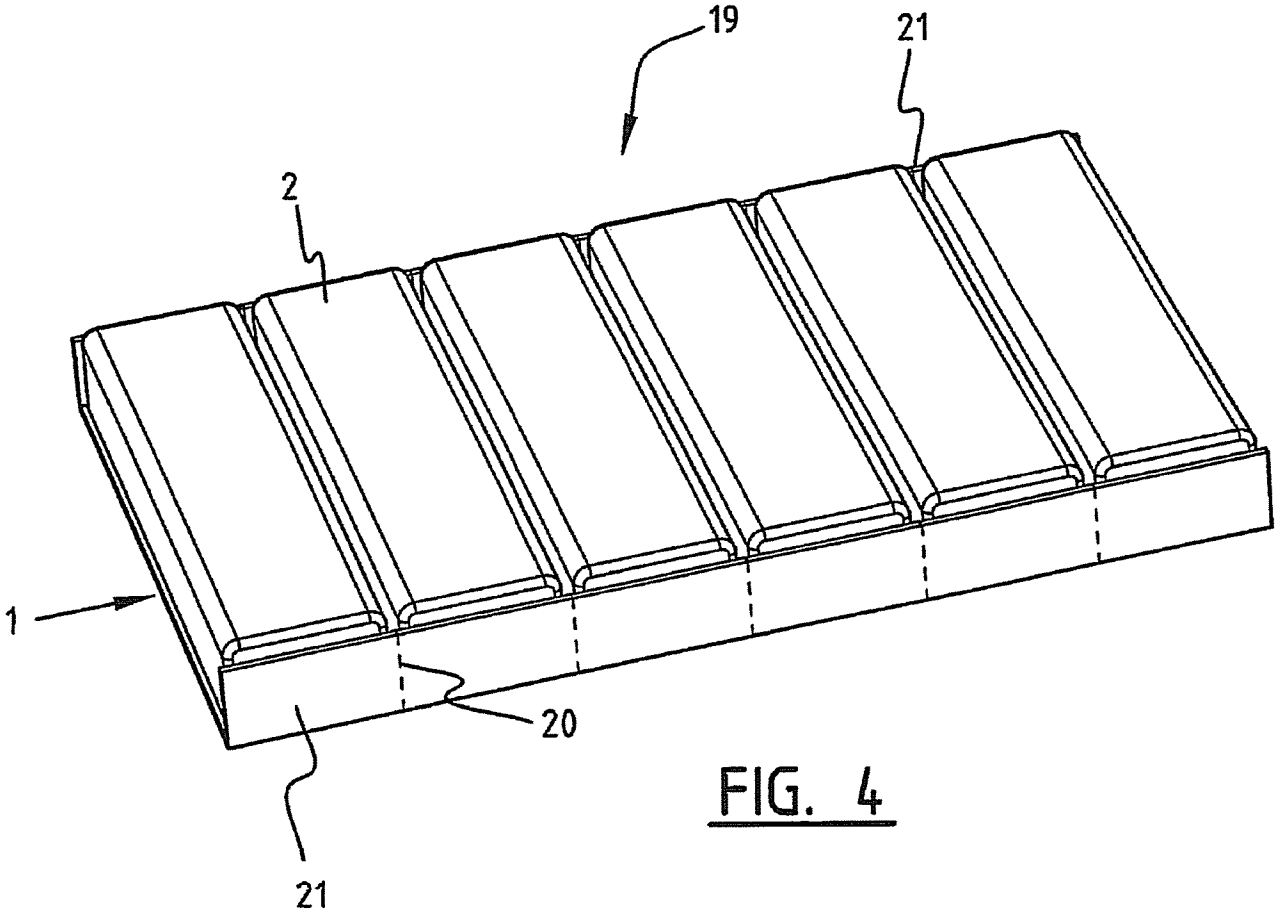
FIG. 4 shows a perspective view of an array of packaged products.

The array 19 of candy bars 3 as shown in FIG. 4 thereby has a cardboard layer 1 on the bottom side and a shaped plastic film layer 2 on the top side which is sealed onto the cardboard layer 1 in between the candy bars 3. These transverse seals have scores or perforations 20 so that individual products can be easily torn off, without breaking the seal. Both sealed longitudinal sides 21 of the package are folded upwards, giving the array 19 such rigidity that it can subsequently be treated as a box. The array 19 can be shipped to and exposed in shops, and sold to the public, without the need to enclose it in a further layer of plastic, as is the case with prior art packaging methods of candy bars.

What is claimed:

1. A method for packaging products comprising the steps of:

placing elongated individual or grouped products spaced a pre-defined distance apart on a conveyor having a transport direction;

continuously moving a bottom, uniformly planar, unshaped first sheet in the same transport direction as said conveyor;

pre-shaping an upper second sheet to fit partially around said products and spaced from the first sheet prior to contacting said products, continuously moving the second sheet in the same transport direction as said conveyor;

positioning the said spaced apart products on the first sheet; and, sealing the first sheet to the second sheet with a sealing device moving at the same speed as the first and second sheets and having sealing ribs extending transversely to the transport direction, said sealing ribs being disposed between said products to form a seal between said spaced apart products, wherein the second sheet is pre-shaped by engaging the second sheet with a rotating first shaping drum on one side of the second sheet and a rotating second shaping drum on the opposite side of the second sheet, wherein each of said shaping drums comprises shaping ribs protruding from the cylindrical surface of the drum and extending transversely to the transport direction of the second sheet, and wherein the shaping ribs of the first shaping drum and the shaping ribs of the second shaping drum co-operate to move between each other while contacting the second sheet.

2. The method according to claim 1, wherein at least one suction device is located on the first shaping drum between the protruding shaping ribs.

3. The method according to claim 2, wherein the at least one suction device at least partially pre-shapes the second sheet.

4. The method according to claim 1 wherein the sealing ribs protrude from the cylindrical surface of a rotating drum.

5. The method according to claim 1, wherein the sealing ribs comprise the protruding shaping ribs of the rotating first shaping drum.

6. The method according to claim 1, wherein at least the first shaping drum is positioned such that it guides the moving second sheet towards the moving first sheet.

7. The method according to claim 1, wherein the sealing device uses ultrasonic sealing to seal the first and second sheets, and wherein the ultrasonic sealing comprises co-operation between an ultrasonic welding device and the sealing ribs.

8. The method according to claim 1, wherein the first sheet comprises a rigid board or film.

9. The method according to claim 8, wherein the first sheet comprises plastic-coated cardboard.

10. The method according to claim 1, wherein the second sheet comprises a flexible foil or film.

11. The method according to claim 1, further comprising sealing the longitudinal sides of the first sheet and the second sheet together to enclose the individual or grouped products in an air-tight package.

12. The method according to claim 11, further comprising folding the longitudinal sides of the sealed first and second sheets upwards, thereby enhancing the rigidity of the air-tight packages.

13. The method according to claim 1, further comprising weakening the sealed areas between the products such that the packaged products stay attached to each other, but can be easily separated.

14. The method according to claim 13, wherein weakening the sealed areas between the products comprises perforating or scoring.

* * * * *